US005576803A

United States Patent [19]

Williams et al.

[11] Patent Number: 5,576,803

[45] Date of Patent: Nov. 19, 1996

[54] ELECTROSTATOGRAPHIC IMAGING DRUM END CAP AND DRUM ASSEMBLY

[75] Inventors: Edward C. Williams, Palmyra; Geoffrey M. T. Foley, Fairport; Robert S. Foltz, Rochester; William G. Herbert, Williamson, all of N.Y.

[73] Assignee: Xerox Corporation, Stamford, Conn.

[21] Appl. No.: 171,040

[22] Filed: Dec. 21, 1993

[51] Int. Cl.[6] ..... G03G 5/00

[52] U.S. Cl. ..... 355/211; 355/200; 492/47

[58] Field of Search ..... 355/213, 211, 355/212, 200; 492/47, 21, 42; 430/31, 32, 46, 56, 80

[56] References Cited

U.S. PATENT DOCUMENTS

| | | | |
|---|---|---|---|
| 1,092,464 | 4/1914 | Watson et al. | 492/47 X |
| 3,994,053 | 11/1976 | Hunt | 355/211 X |
| 4,105,345 | 8/1978 | Van Wagner | 355/211 X |
| 4,120,576 | 10/1978 | Babish | 355/200 |
| 4,400,077 | 8/1983 | Kozuka et al. | 355/211 |
| 4,561,763 | 12/1985 | Basch | 355/200 |
| 4,639,122 | 1/1987 | Pease | 355/299 |
| 4,914,478 | 4/1990 | Yashiki | 355/211 |
| 4,929,524 | 5/1990 | Sakai et al. | 430/56 |
| 5,023,660 | 6/1991 | Ebata et al. | 355/200 |
| 5,052,090 | 10/1991 | Kitaura et al. | 355/211 X |
| 5,313,255 | 5/1994 | Taniguchi et al. | 355/211 |
| 5,357,328 | 10/1994 | Lundy | 355/301 |
| 5,521,678 | 5/1996 | Riehle et al. | 355/211 |

FOREIGN PATENT DOCUMENTS

| | | |
|---|---|---|
| 56-52770 | 9/1981 | Japan . |
| 58-86585 | 5/1983 | Japan . |
| 58-85547 | 5/1983 | Japan . |
| 58-86552 | 5/1983 | Japan . |
| 58-87579 | 5/1983 | Japan . |

*Primary Examiner*—Shuk Yin Lee

[57] ABSTRACT

An electrostatographic imaging member assembly including a hollow electrostatographic imaging drum having a first end and a second end, at least one coating on the drum extending to at least the first end of the drum, the coating having an outer electrostatographic imaging surface and a first drum supporting end cap mounted on the first end of the drum, the first drum supporting end cap including a disk shaped member having an annular skirt encircling an exterior surface of the first end of the cylindrical substrate, the annular skirt having an imaginary axis coextensive with an imaginary axis of the drum. This electrostatographic imaging member assembly may be fabricated by sliding the skirt of the end cap over the end of the drum with or without presoftening of the coating. The electrostatographic imaging member assembly may be utilized in electrostatographic imaging apparatus in which the end caps support electrostatographic imaging apparatus subassembly components.

10 Claims, 1 Drawing Sheet

ELECTROSTATOGRAPHIC IMAGING DRUM END CAP AND DRUM ASSEMBLY

BACKGROUND OF THE INVENTION

This invention relates in general to drum support apparatus and more specifically to a drum supporting end cap, a drum assembly containing the end cap and method for fabricating the drum assembly.

Electrostatographic imaging drums are well known in the art. These drums comprise a hollow cylindrical substrate and at least one electrostatographic coating. These drums are usually supported by a hub held in place at the end of each drum by a flange extending from the hub into the interior of the drum and retained in place by an interference fit and/or an adhesive. An axle shaft through a hole in the center of each hub supports the hub and drum assembly. Where a hollow cylindrical imaging drum has a cross section circumscribed by the interior drum surface which is not fully concentric with the cross section circumscribed by the exterior drum surface, misalignment occurs between the center holes of the drum supporting hubs and the true axis of the drum. Since some electrostatographic imaging drums have inner and outer surfaces that are not perfectly concentric with each other, particularly extruded drums, these drums tend to wobble when rotated around their axle shaft. Such wobble is undesirable where precise spacing is required between the electrostatographic coating and various subsystems of the imaging system such as developing, cleaning and charging substations. In order to achieve uniform spacing between the imaging apparatus subsystems and the imaging surface of the drum, one may utilize spacing or support elements extending from the subsystems such as struts, shoes, or wheels which actually ride on the drum surface. Thus, any wobble of the drum will merely cause the subsystem to maintain its position relative to the adjacent surface of the drum as the drum wobbles as it rotates. This arrangement also compensates for variations in conicity of the drum. The use of spacing or support elements extending from electrostatographic subsystems to ride directly on a drum surface is well known in the art and is disclosed, for example, in U.S. Pat. Nos. 3,869,203 and 3,998,184. The disclosures of these patents are incorporated herein in their entirety.

One common technique for fabricating these electrostatographic imaging drums involves dip coating the drum into a coating bath to form a dielectric layer for electrographic imaging members or to form at least one electrophotographic layer for electrophotographic imaging members. During the dip coating process, one end of the drum substrate is vertically submerged with the axis of the drum substrate maintained in a vertical orientation until most or all of the external drum substrate surface is coated with the coating solution. Since the upper boundary of the applied coating layer tends to have a non-uniform thickness, the electrical properties thereat are also non-uniform. This problem is minimized by bringing the coating to the top of the substrate during dip coating so that the region actually utilized for electrostatic imaging is spaced away from the coating boundary. Since at least the bottom end of the substrate is coated and, in the latter situation, the upper end is also coated, difficulties are encountered when subsystems employed in cooperation with the electrostatographic imaging drum are spaced from the imaging surface of the electrostatic imaging drum by spacing means that ride on one or both ends of the drum to achieve more accurate spacing tolerances. These spacing means attempt to achieve spacing tolerances by compensating for situations where the drum is not perfectly round and/or the supporting drum axle shaft is not perfectly centered along the center line of the drum axis.

The spacing means which ride on the surface of the drum usually comprise a strut fitted with a roller or low friction foot. Such spacing means are well known in the art and are described, for example, in U.S. Pat. Nos. 3,869,203 and 3,998,184, referred to above. As the drum is rotated through many imaging cycles, the spacing means causes erosion of the coating on the drum substrate in the regions contacted by the spacing means and the resulting eroded coating debris forms an undesirable dust which settles on critical surfaces within the machine such as the imaging surface, corona wires, optic system components, and the like. To avoid this problem, the coating on at least one end of the drum (if the other end remains uncoated) is removed prior to installation of the drum in an electrostatographic imaging machine such as a copier, duplicator, printer or the like. Attempts to remove the coating with the aid of solvents can cause solvent splashing or fumes which can damage areas of the coating which are to be subsequently utilized for imaging. Also, removal with solvents is usually employed in combination with a wiping means such as a brush or pad which are unreliable and often fail to remove all of the coating material at the end of the imaging drum. Moreover, disposal or recovery of the solvent can be hazardous, time consuming and expensive. The coating can also be removed by use of a laser beam, but such laser systems are also complex and expensive. Moreover, the solvent/wiping or laser systems for removal of coatings are bulky and prevent achievement of high substrate population density for efficient coating and cleaning operations. Masking techniques may also be employed to remove deposited coatings from the ends of drum substrates. More specifically, a masking tape may be applied to the end or ends of a drum substrate to allow the coating to deposit on the tape instead of on the underlying substrate. The coating deposited on the tape is removed when the tape is stripped from the substrate after the coating operation. These operations all adversely affect production costs, factory floor space requirements and the like. After the coating material has been removed from at least one end of a coated drum, including any coating material deposited on the interior of at least the bottom of the drum, a hub is installed to support the drum on an axle shaft for rotation in an electrostatographic imaging machine.

When a bare strip is formed on the drum by removal of coatings adjacent to the end of the electrostatographic imaging member to expose the underlying substrate, cycling of such an imaging member during imaging in systems involving steps such as liquid development and wiping to clean the imaging surface tends to expose the edges of the electrostatographic coating, particularly any underlying more vulnerable layers, to solvent used in the liquid ink developer thereby causing deterioration of the layers and degradation of the imaging capabilities of the electrostatographic imaging member.

Hubs are often glued into place on the ends of drums. The gluing operation tends to be unreliable and expensive because a uniform bead of glue must be applied to the hub prior to insertion of the hub into one end of the drum. To ensure that the applied bead is uniform, an expensive electronic vision system is usually necessary for automated fabrication systems. Since the glue is often a thermosetting glue such as a two part epoxy resin, the hub must be hammered off when spent drum assembly components are to be recycled. Hammering can damage the hub and/or drum substrate thereby rendering these components useless for simple, direct recycling. Also, any glue and/or coating material remaining on the inside surface of the drum substrate can interfere with a subsequent electrical grounding function.

Hubs have also been used which have a peripheral support surface to space subsystems from the imaging surface of the electrostatic imaging drum by allowing a subsystem spacing means to ride on the peripheral support surface of the hub. The hub is held in place by press fitting a flange extending from the hub into the interior of the drum. This type of hub is described in Japanese Patent Publication 58-87579, published May 5, 1983. However, for hollow cylindrical substrates having a circular cross section circumscribed by an interior surface of the substrate which is not fully concentric with a circular cross section circumscribed by the exterior surface of the substrate, as is often the case with extruded substrates, the cross section circumscribed by the peripheral support surface of a hub (support ring) such as that of Japanese Patent Publication 58-87579 will be concentric with the circular cross section circumscribed by the interior surface of the substrate, and therefore, will not be concentric with a circular cross section circumscribed by the outer surface of the substrate. Thus, these types of spacing means do not achieve high spacing tolerances because they fail to compensate for situations where the interior surface of the drum is not perfectly round and/or is not concentric with the outer drum surface and/or the supporting drum axle shaft is not perfectly centered along the true center line of the drum axis. Therefore, for these situations, a peripheral support surface of the hub may be concentric with the interior surface of a drum, but will not be concentric with the exterior surface of the drum thereby causing unacceptable variations in spacing between a subsystem component and the exterior surface of the drum in precision imaging machines that demand close tolerances. An extruded cylindrical substrate having an interior surface that is not concentric with the exterior surface can be modified by mounting a raw, as extruded, substrate on a lathe using internal diameter of the substrate as the lathing datum and lathing material from the substrate in typically two or more cuts until the outer surface is concentric with the internal surface of the substrate. However, such lathing subjects the walls of the substrate to considerable force and the substrate walls must be relatively thick in order to survive the rigors of lathing. Thicker substrate walls add undesirably to the mass of the substrate and also to its cost.

Thus, there is a continuing need for improved photoreceptors that are more reliable and simpler to fabricate.

INFORMATION DISCLOSURE STATEMENT

Japanese laid open Patent Application 58-87579, published May 25, 1983—A drum assembly is disclosed wherein an electroformed thin cylinder coated with photosensitive coating is fitted at each end with support rings having an exposed outer perimeter having a surface which supports rotating wheels. A device is held in position spaced from the photoconductive coating by the rotating wheels as they ride on the peripheral surface of the support rings.

U.S. Pat. No. 4,561,763 to D. C. Basch issued on Dec. 31, 1985—A drum supporting hub is disclosed having a tapered pot-like hub configuration comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. Preferably, the height of the lips is flush with the outer surface of the cylindrical drum when the drum supporting hub is fully inserted into the cylindrical drum. This flush surface permits cams, seals or other mechanical means in an electrophotographic imaging apparatus to ride slightly off the edge of the cylindrical drum without interference by lip 30. The drum supporting hub is employed in a drum assembly comprising the hub, a cylindrical drum having a circular cross section and a shaft positioned along the axis of the drum.

SUMMARY OF THE INVENTION

It is, therefore, an object of the present invention to provide an improved drum supporting end cap and drum assembly which overcomes the above-noted disadvantages.

It is another object of this invention to provide an improved drum supporting end cap and drum assembly wherein the drum has been coated from one end to the other whereby the electrical properties of the coating in the imaging region are uniform.

It is a further object of this invention to provide an improved drum supporting end cap and drum assembly which eliminates a need for solvent recovery or disposal.

It is still another object of this invention to provide an improved drum supporting end cap and drum assembly which is more reliable and efficient.

It is a further object of this invention to provide an improved drum supporting end cap and drum assembly which eliminates a fabrication process step.

It is another object of this invention to provide an improved drum supporting end cap and drum assembly that enables safer techniques for fabricating coated electrostatographic imaging members.

It is still another object of this invention to provide an improved drum supporting end cap and drum assembly which eliminates the need for glue application and electronic vision subsystems.

It is a further object of this invention to provide an improved drum supporting end cap and drum assembly which eliminates the need for masking and unmasking substrates during coating operations.

It is another object of this invention to provide an improved drum supporting end cap and drum assembly that accommodates changes in substrate diameters without any need for bulky equipment for the removal of coating from the ends of substrates having different diameters.

It is still another object of this invention to provide an improved drum supporting end cap and drum assembly which allows closer center-to-center substrate spacings during dip coating because coating edge removal subsystems have been eliminated from the coating apparatus.

It is still another object of this invention to provide an improved drum supporting end cap and drum assembly which facilitate recycling of electrostatographic drums and end caps.

It is yet another object of this invention to provide an improved drum supporting end cap and drum assembly which reduces the number of assembly steps utilized to manufacture an electrostatographic drum.

It is another object of this invention to provide an improved drum supporting end cap and drum assembly which eliminates the need for applying glue to mount an end cap to the end of an electrostatographic drum.

It is another object of this invention to provide an improved drum supporting end cap and drum assembly which quickly achieves excellent anchoring of the end cap to the drum.

It is yet another object of this invention to provide a drum assembly which can be centerless ground instead of lathed.

It is another object of this invention to provide a drum assembly which can utilize less costly cylinders.

The foregoing and other objects of the present invention are accomplished by providing an electrostatographic imaging member assembly comprising a hollow electrostatographic imaging drum having a first end and a second end, at least one coating on the drum extending to at least the first end of the drum, the coating having an outer electrostatographic imaging surface and a first drum supporting end cap mounted on the first end of the drum, the first drum supporting end cap comprising a disk shaped member having an annular skirt encircling an exterior surface of the first end of the cylindrical substrate, the annular skirt having an imaginary axis coextensive with an imaginary axis of the drum. This electrostatographic imaging member assembly may be fabricated by sliding the skirt of the end cap over the end of the drum with or without presoftening of the coating. The electrostatographic imaging member assembly may be utilized in electrostatographic imaging apparatus in which the end caps support electrostatographic imaging apparatus subassembly components.

BRIEF DESCRIPTION OF THE DRAWINGS

In general, the advantages of the improved drum supporting hub and drum assembly will become apparent upon consideration of the following disclosure of the invention, particularly when taken in conjunction with the accompanying drawings wherein.

These figures merely schematically illustrate the invention and are not intended to indicate relative size and dimensions of actual devices components thereof.

DETAILED DESCRIPTION OF THE DRAWINGS

The present invention may be employed in any suitable device that requires support for a drum. However, for purposes of illustration, the invention will be described with reference to an electrostatographic imaging system. A typical electrophotographic imaging system is illustrated in U.S. Pat. No. 3,900,258 to R. F. Hoppner et al and U.S. Pat. No. 3,998,184 to D. H. Hudson, the entire disclosures thereof being incorporated herein by reference.

Figure 1:
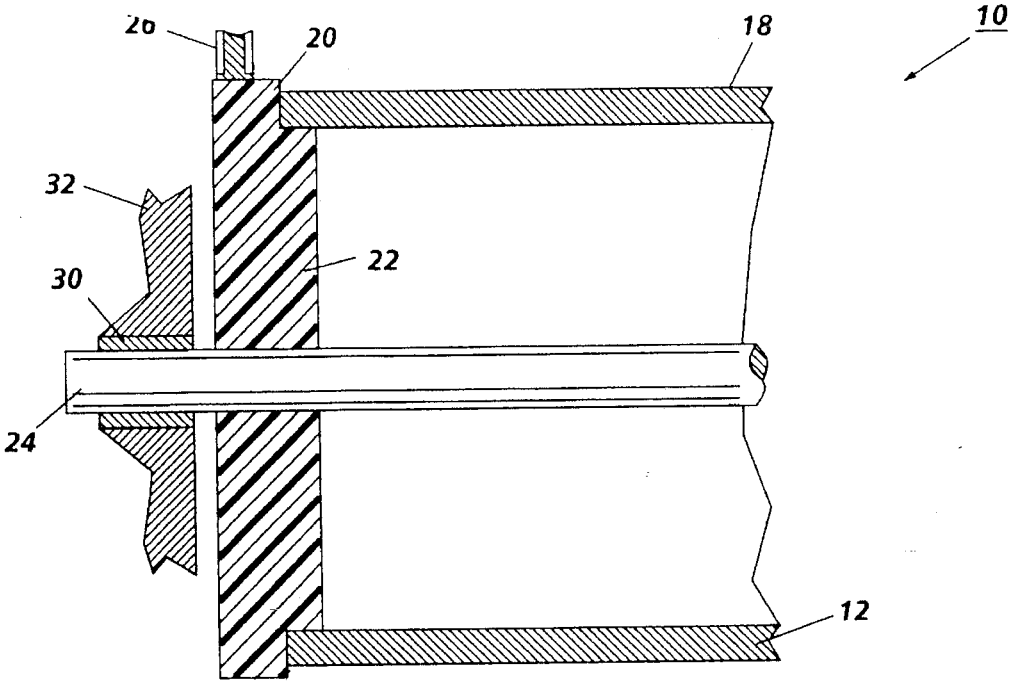
FIG. 1 is a schematic illustration of an electrostatographic imaging member assembly of the prior art.

Referring to FIG. 1, a prior art electrostatographic imaging member assembly 10 is illustrated comprising a hollow electrostatographic imaging drum 12 having an outer surface 14. A drum support hub 16 comprising a disk shaped flange 18 is pressed fitted into one end of hollow electrostatographic imaging drum 12. Drum support hub 16 has an exposed circular periphery having an annular landing strip surface 20 which is parallel to, but slightly higher than the outer surface 14. Riding on the annular landing strip 20 is a subsystem wheel 22. Axle shaft 24 extends through a hole in the center of the drum supporting hub 16 and extends into bearing 30 secured to housing 32. Axle shaft 24 extends through the center of another drum supporting hub (not shown) which is press fitted into the opposite end of imaging drum 12.

Figure 2:
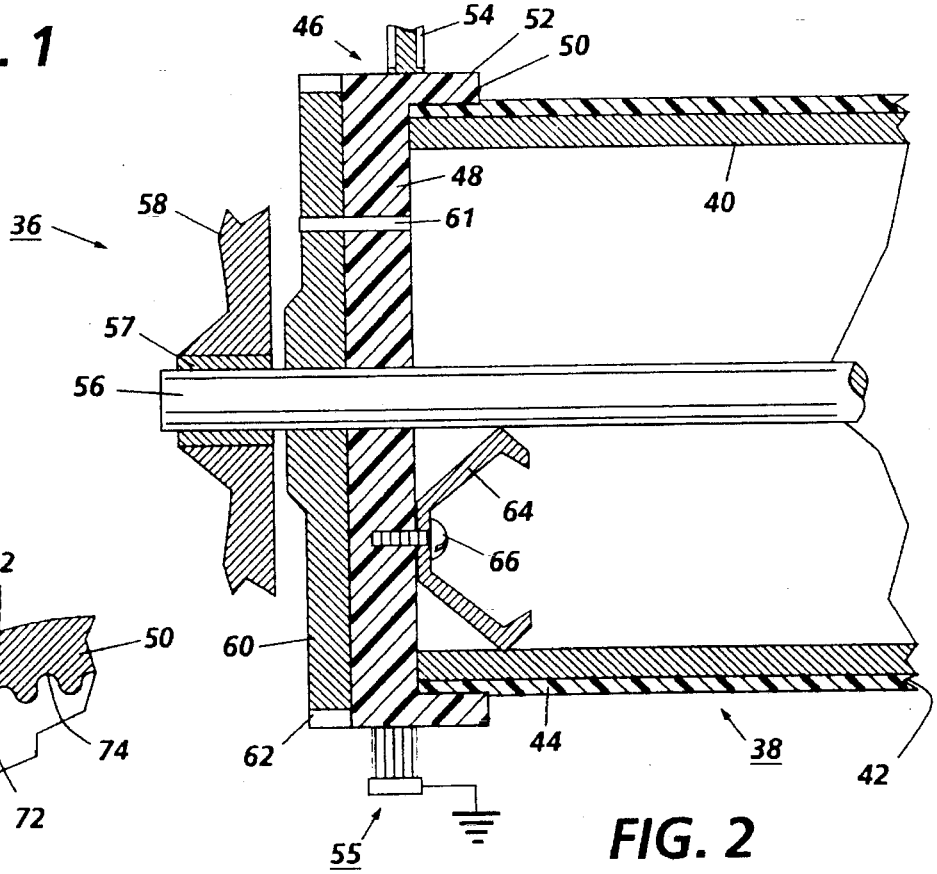
FIG. 2 is a schematic illustration of an electrostatographic imaging member assembly of this invention.

In FIG. 2, an electrostatographic imaging member assembly 36 comprising a hollow electrostatographic imaging drum 38 which comprises a hollow cylindrical substrate 40 coated with imaging coating 42. Imaging coating 42 has an outer electrostatographic imaging surface 44. Electrostatographic imaging member assembly 36 also includes drum supporting end caps 46 and 47, each comprising a disk shaped segment 48 having a skirt 50 which extends around and is concentric with the exterior surface of cylindrical substrate 40. An annular landing strip surface 52 encircles the outer surface of end cap skirt 50 and disk shaped segment 48. Drum supporting end caps 46 and 47 may comprise any suitable electrically conductive or electrically insulating material. Typical electrically conductive materials include, for example, metals, such as steel, stainless steel, aluminum, nickel, copper, silver, brass, carbon fibers, resins filled with electrically conductive particles such as carbon black, composite materials containing electrically conductive particles of copper, silver, and the like. Typical electrically insulating materials include, for example, film-forming thermoplastic resins and thermosetting resins.

Riding on annular landing strip surfaces 52 are subsystem support wheels 54. Generally, the width of annular landing strip surface 52 should be at least about three millimeters. This minimum width is required to prevent undue wear during frictional contact with supporting elements of imaging apparatus subsystem 53 such as subsystem support wheel 54 during image cycling. Imaging apparatus subsystems are well known and include, for example, developer housings, corotrons, cleaning blades, cleaning brushes, and the like, the support wheel 54 of the subsystem 53 being shown in FIG. 2. If desired, other suitable support means may be employed in place of support wheel 54 such as a low coefficient of friction plastic housing leg, cam, seal or other mechanical means (not shown) extending from an imaging apparatus subsystem or other device or element. Subsystem support wheels 54 or other typical support element may be positioned to ride on annular landing strip surface 52 directly over end cap skirt 50 only, directly over the periphery of disk shaped segment 48, or partially over both end cap skirt 50 the periphery of disk shaped segment 48. If drum supporting end cap 46 is electrically conductive, it may be utilized as an electrical connection between grounding brush 55 riding on annular landing strip surface 52 and conductive substrate 40. Grounding brush 55 made comprise any suitable conductive material such as, for example, carbon fibers or fine metallic fiber. Alternatively, a grounding roller or the like may be utilized in place of a grounding brush. Conductive grounding brush 55-53 may be used in combination with subsystem support wheel 54, or either subsystem support wheel 54 or conductive grounding brush 55 may be used without the other. Where end cap 46 is electrically conductive, grounding brush 55 may contact axle shaft 56 instead of landing strip surface 52.

An axle shaft 56 extends through the center of drum supporting end cap 46 and into bearing 57 carried by housing 58 on one end of drum 38. The other end of axle shaft 56 extends through other end cap 47 which may be similar to end cap 46. End cap 46 may be fixed to axle shaft 56 so that both rotate together or end cap 46 may be freely rotatable around axle shaft 56. End cap 46 may be fixed to axle shaft 56 by any suitable means such as a set screw, key and slot arrangement (not shown). Attached to end cap 46 is optional gear 60 having teeth 62 around its periphery. If desired, gear 60 may be formed as an integral part of end cap 46 in a molding process Alternatively, gear 60 may be separately formed and secured to end cap 46 by any suitable and conventional means such as screws, bolts, adhesives, press fit, snap fit, keyed (facilitates replacement and salvage), sonic welding, crimping, or the like. If optional gear 60 is employed, it will normally be used with an end cap at one end of imaging drum 38 and not at both ends. Gear teeth 62 are adapted to engage with the teeth of another gear (not shown) connected to a suitable power source as is conventional in the art. Such an arrangement is well known in the art and is illustrated, for example, in U.S. Pat. No. 3,900,258 to R. F. Hoppner et al, the entire disclosure thereof being incorporated herein by reference. Alternatively, end cap 46 may be driven directly by hexagonal or square axle shafts (not shown) which mate with correspondingly shaped openings in end cap 46. Where end cap 46 is fixed to axle shaft 56, shaft 56 may be driven directly by an electric motor (not shown) or by any other suitable power source, as is well known in the art.

An optional grounding clip 64 may be secured to disk shaped segment 48 of drum supporting end cap 46 by any suitable means such as screw 66. Grounding clip 64 may be formed from any suitable electrically conductive and flexible material such as stainless steel, brass, copper beryllium, and the like. Grounding clip 64 should be maintained in frictional contact with axle shaft 56 and the interior surface of substrate 40 to electrically ground substrate 40 to electrically conductive axle shaft 56 as is well known in the art. Obviously, where end cap 46 is electrically conductive, end cap 46 may itself function as an electrical connection between drum substrate 40 and electrically conductive axle shaft 56. Ground clip 64 is optional and may be utilized where end cap 46 is fabricated from electrically insulating material At least one end cap 46 having an annular landing strip surface 52 is required to support a subsystem support element, such as subsystem support wheel 54, because at least one end of hollow cylindrical substrate 40 of electrostatographic imaging drum 38 is coated to its very end. If cylindrical substrate 40 is not totally submerged during dip coating, an uncoated band (not shown) may be formed at the upper end of substrate 40 and this uncoated band may be utilized for supporting a subsystem support wheel 54 or other suitable support element. Where coating 42 fully extends to each end of substrate 40, or where coating 42 fully extends all the way to one end of substrate 40 and substantially extends to the other end of substrate 40 such that there is insufficient uncoated surface on substrate 40 to support subsystem support wheel 54, end caps 46 and 47 of this invention are preferably utilized at each end of imaging drum 38. Where one subsystem support wheel 54 rides on annular landing strip surface 52 of end cap 46 at one end of substrate 40 and the other subsystem support wheel (not shown) rides directly on an uncoated band (not shown) at the other end of substrate 40, adjustments should be made to subsystem support wheels to compensate for the thickness of end cap skirt 50.

Any suitable arrangement may be utilized to position drum supporting end caps 46 and 47 at the end of imaging drum 38. For example, the inner surface of disc shaped segment 48 of end cap 46 may have a landing which abuts and aligns with the squared face at the adjacent end of imaging drum 38. End cap skirt 50 extends from disc shaped segment 48 over the exterior of cylindrical substrate 40 and fits snugly over the exterior of cylindrical substrate 40 thereby accurately centering end cap 46 relative to the cross section circumscribed by the outer surface of imaging drum 38 as well as the outer surface of electrostatographic imaging drum 38. The interior surface of end cap 46 may be smooth or roughened. An example of a roughened surface is one made up of a plurality of projections in the shape of peaks or ridges and corresponding valleys. An imaginary circular ribbon or belt connecting the peaks or ridges may have a circumference slightly smaller than the outer circumference of the drum to achieve a press or interference fit of end cap skirt 50 over the exterior of cylindrical substrate. Moreover, the pattern of ridges or peaks may be irregular or regular. However, an interference fit is more desirable for relatively thick drums where undesirable distortion of the drum substrate is less likely to occur. If desired, the inner surface of end cap skirt may have a slightly tapered or flared configuration (not shown) where the taper or flare provides a larger diameter at the free end of end cap skirt 50 to facilitate sliding of end cap 46 onto the end of imaging drum 38. This flared configuration reduces any plowing effect that might occur when end cap 46 is mounted onto one end of imaging drum 38 and the free end of end cap skirt 50 pushes some of imaging coating 42 toward the opposite end of imaging drum 38. Annular landing strip surface 52 on the exterior surface of end cap skirt 50 is preferably smooth to minimize wear and vibration. A smooth surface can also compensate for cylindrical substrates 40 having a somewhat rough exterior surface which could cause wear and vibration if subsystem support wheel 54 rode directly on such rough exterior surface instead of on smooth annular landing strip surface 52. Disc shaped segment 48 may optionally contain bleed holes 61 to facilitate mounting or dismounting of end cap 46 from an end of imaging drum 38.

Figure 3:
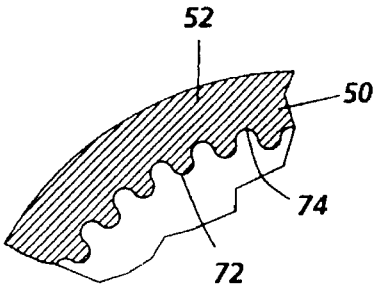
FIG. 3 is a partial cross section of an end cap skirt embodiment of this invention.

Referring to FIG. 3, a partial cross section of end cap skirt 50 is shown in which the inner surface of end cap skirt 50 adjacent to the outer surface of substrate 40 has ridges 72 and valleys 74 in a regular pattern. Although a regular pattern is illustrated in FIG. 3, the pattern may be irregular, if desired. These ridges 72 and valleys 74 enhance gripping of the inner surface of end cap skirt 50 with the outer surface of cylindrical substrate 40 and resist slippage between end cap skirt 50 and substrate 40. Valleys 74 function as a reservoir into which coating 42 can be directed to reduce any plowing effect while end cap skirt 50 is slid onto the end of cylindrical substrate 40. Ridges 72 may also have leading edges which are both chamfered and parabolic (shaped like the bow of a sail boat) to facilitate movement of coating 42 into the reservoirs formed by valleys 74. The thickness and width of skirt 50 should be sufficient to resist the stresses applied during use in imaging systems. The material utilized in the skirt will also affect the minimum thickness desired. A typical thickness for an end cap of molded of polyphenylene oxide such as Noryl® available from General Electric Co. is about 2 millimeters.

End caps 46 may be mounted onto at least one end of imaging drum 38 by any suitable technique. For example, end cap skirt 50 may merely be slid over a coated end of imaging drum 38 with the aid of pressure applied to end cap skirt 50 with the applied pressure having a component in a direction parallel to the axis of imaging drum 38, e.g. end cap 46 can be applied with a twisting motion onto drum 38. The inner circumference of end cap skirt 50 relative to the outer circumference of substrate 40 can be selected to achieve a friction or interference fit. The relative size of these circumferences selected will depend upon a number of factors such as the type of texture employed for the inner surface of end cap skirt 50, the hardness of coating 42 during the mounting process, and the technique employed for mounting. When a friction or interference fit is utilized to retain end caps 46 to imaging drum 38, spacing distance between the interior surface of end cap skirt 50 and the exterior surface of substrate 40 is preferably a negative number. Typically, for an end cap skirt 50 having ridges 72, the negative number may be about 0.05 millimeter based on the diameters of the skirt and substrate, e.g. the diameter of an imaginary circle having a circumference which intersects the peaks of ridges 72 will be about 0.05 millimeter smaller than the outside diameter of the substrate 40. A preferred mounting technique involves applying a solvent for coating 42 onto the inner surface of end cap skirt 50 by any suitable process such as brushing or spraying and slowly sliding end cap skirt 50 over coating 42 at one end of drum 38. The solvent softens the portion of coating 42 contacted by the solvent and upon subsequent drying, the portion of coating material 42 sandwiched between the inner surface of end cap skirt 50 and outer surface of substrate 40 functions as an adhesive. Little or no interference friction fit is needed for this solvent technique. Since most electrostatographic imaging layers comprise a solvent soluble thermoplastic film forming binder in the continuous phase of one or more imaging layers, selection of suitable combinations of specific solvents for the specific solvent soluble thermoplastic film forming binder used in the imaging layer can be accomplished with the aid of virtually any common materials handbook. Typical combinations include, for example, polycarbonate film forming binder and methylene chloride solvent; polystyrene film forming binder and methylene chloride solvent; and the like. Alternatively, end cap skirt 50 may be preheated to a temperature which will soften the portion of coating 42 contacted by end cap skirt 50. Typically, for an end cap skirt 50 having ridges 72 and where coating 42 is used as an adhesive, the distance, based on the diameters of the skirt (e.g. the diameter of an imaginary circle having a circumference which intersects the peaks of ridges 72) and the outer circumference of substrate 40 is about half the coating thickness and preferably less than about 90 percent of the thickness of coating 42. When it is desired to remove end cap 46 application of heat to the exterior surface of end cap skirt 50 and/or the interior of substrate 40 will soften the portion of coating 42 contacted by end cap skirt 50 to permit ready removal of end cap 46 from imaging drum 38. Since end cap 46 may be easily removed from imaging drum 38 without damage to drum 38 or end cap 46, both components may be recycled with less waste of material and less expenditure of time.

The end caps of this invention may be identical in shape at each end of the imaging drum or different.

As indicated above, many hollow cylindrical substrates having a circular cross section circumscribed by an interior surface of the substrate which is not fully concentric with a circular cross section circumscribed by the exterior surface of the substrate. Since the cross section circumscribed by the peripheral support surface of prior art hubs (support ring) that are concentric with the circular cross section circumscribed by the interior surface of the substrate, it will not be concentric with a circular cross section circumscribed by the outer surface of the substrate. Thus, these types of spacing means do not achieve high spacing tolerances because they fail to compensate for situations where the interior surface of the drum is not perfectly round and/or is not concentric with the outer drum surface and/or the supporting drum axle shaft is not perfectly centered along the true center line of the drum axis. Therefore, for these situations, a peripheral support surface of the hub may be concentric with the interior surface of a drum, but will not be concentric with the exterior surface of the drum thereby causing unacceptable variations in spacing between a subsystem component and the exterior surface of the drum in precision imaging machines that demand close tolerances. An extruded cylindrical substrate having an interior surface that is not concentric with the exterior surface can be modified by mounting a raw, as extruded, substrate on a lathe using internal diameter of the substrate as the lathing datum and lathing material from the substrate until the outer surface is concentric with the internal surface of the substrate. However, such lathing subjects the walls of the substrate to considerable force and the substrate walls must be relatively thick in order to survive the rigors of lathing. Thicker substrate walls add to the mass of the substrate and also to its cost.

Since the electrostatographic imaging member assembly of this invention utilizes the outer surface of a substrate as a datum, centerless grinding of the substrate is enabled. Centerless grinding is more easily automated than lathing. Also, centerless grinding applies far less force to a substrate than lathing. Thus, substrate wall thickness may be reduced. A reduction of wall thickness reduces both the mass and cost of the substrate. Reduced substrate mass also minimizes difficulties encountered during substrate coating and drying operations and reduces the need to compensate for drum assembly inertia during copying or printing processes. In addition, the improved drum supporting end cap and drum assembly utilizes drums coated from one end to the other to achieve more uniform electrical properties of the coating in the imaging region. Further, the improved drum supporting end cap and drum assembly of this invention eliminates a need for solvent recovery or disposal. Also, the improved assembly which is more reliable and efficient. Moreover, a fabrication process step is eliminated. In addition, the improved drum supporting end cap and drum assembly eliminates the need for masking and unmasking substrates during coating operations. The assembly design also permits changes in substrate diameters without any need for bulky equipment for the removal of coating from the ends of substrates having different diameters. Further, the improved drum supporting end cap and drum assembly of this invention allows closer center-to-center substrate spacings during dip coating because coating edge removal subsystems have been eliminated from the coating apparatus. Moreover, the assembly of this invention facilitates recycling of electrostatographic drums and end caps. Excellent anchoring of the end cap to the drum is also quickly achieved with the improved drum supporting end cap and drum assembly of this invention.

The invention has been described in detail with particular reference to preferred embodiments thereof but it will be understood that variations and modifications can be effected within the spirit and scope of the invention as described herein above and as defined in the appended claims.

What is claimed is:

1. An electrostatographic imaging member assembly comprising a hollow electrostatographic imaging drum having a first end and a second end, at least one coating on said drum extending to at least said first end of said drum, said coating having an outer electrostatographic imaging surface and a first drum supporting end cap mounted on said first end of said drum, said first drum supporting end cap comprising a disk shaped member having an annular skirt encircling an exterior surface of said first end of said drum, said annular skirt having an imaginary axis coextensive with an imaginary axis of said drum, said end cap having an exposed circular periphery comprising an annular landing strip surface extending around said periphery, said annular landing strip surface being parallel to said imaging surface, and said annular landing strip surface having a width of at least about 3 millimeters.

2. An electrostatographic imaging member assembly according to claim 1 wherein a second drum supporting end cap is mounted on said second end of said drum, said second end cap comprising a disk shaped member having an annular skirt encircling said second end of said drum, said annular skirt of said second end cap having an imaginary axis coextensive with an imaginary axis of said drum.

3. An electrostatographic imaging member assembly according to claim 1 wherein said annular skirt has an inner surface in contact with said imaging drum, said inner surface having a roughened texture.

4. An electrostatographic imaging member assembly according to claim 1 wherein said annular skirt of said first end cap has an interior surface adhesively secured to said first end of said drum by said coating underlying said annular skirt.

5. Apparatus for electrostatographic imaging comprising an electrostatographic imaging member assembly comprising a hollow electrostatographic imaging drum having a first end and a second end, at least one coating on said drum extending to at least said first end of said drum, said coating having an outer electrostatographic imaging surface and a first drum supporting end cap mounted on at least said first end of said drum, said first drum supporting end cap comprising a disk shaped member having an annular skirt encircling said first end of said drum, said annular skirt having an imaginary axis coextensive with an imaginary axis of said drum, said first drum supporting end cap having an exposed circular periphery comprising an annular landing strip surface extending around said periphery, said annular landing strip surface being parallel to said imaging surface, and at least one subassembly in contact with said annular landing strip surface.

6. Apparatus according to claim 5 wherein said electrostatographic imaging member assembly comprises a second drum supporting end cap at said second end of said drum, said first drum supporting end cap comprising a disk shaped member having an annular skirt encircling said second end of said cylindrical substrate, said annular skirt having an imaginary axis coextensive with an imaginary axis of said drum, said second drum supporting end cap having an exposed circular periphery comprising an annular landing strip surface extending around said periphery, said annular landing strip surface of said second drum supporting end cap being parallel to said imaging surface, and said subassembly contacts said annular landing strip surface of said second drum supporting end cap.

7. Apparatus according to claim 5 wherein said subassembly is a corona charging unit.

8. Apparatus according to claim 5 wherein said subassembly is a developer applicator unit.

9. Apparatus according to claim 5 wherein said subassembly is an electrical grounding means.

10. An electrostatographic imaging member assembly comprising a hollow electrostatographic imaging drum having a first end and a second end, at least one coating on said drum extending from said first end to said second end of said drum, said coating having an outer electrostatographic imaging surface, a first drum supporting end cap mounted on said first end of said drum, said first drum supporting end cap comprising a disk shaped member having an annular skirt encircling an exterior surface of said first end of said drum, said annular skirt having an imaginary axis coextensive with an imaginary axis of said drum, and a second drum supporting end cap mounted on said second end of said drum, said second end cap comprising a disk shaped member having an annular skirt encircling said second end of said drum, said annular skirt of said second end cap having an imaginary axis coextensive with said imaginary axis of said drum.

* * * * *